US005299412A

United States Patent [19]

Cudney et al.

[11] Patent Number: 5,299,412

[45] Date of Patent: Apr. 5, 1994

[54] IMPACT ABSORBING EQUESTRIAN SADDLE PAD

[75] Inventors: Douglas J. Cudney; Karen E. Breitbach, both of Orangeville, Canada

[73] Assignee: Tipperary Sport Products, Inc., Orangeville, Canada

[21] Appl. No.: 66,253

[22] Filed: May 25, 1993

[51] Int. Cl.[5] ..... B68C 1/12

[52] U.S. Cl. ..... 54/66

[58] Field of Search ..... 54/44.5, 65, 66

[56] References Cited

U.S. PATENT DOCUMENTS

| | | | |
|---|---|---|---|
| 568,474 | 9/1896 | Clark . | |
| 595,111 | 12/1897 | Perry . | |
| 709,930 | 9/1902 | Rensman | 54/66 |
| 721,653 | 3/1903 | Amos | 54/66 |
| 1,824,488 | 9/1931 | Kopf | 54/66 |
| 2,072,188 | 3/1935 | Tauber | 54/66 |
| 4,242,769 | 1/1981 | Rayfield et al. | 9/330 |
| 4,471,538 | 9/1984 | Pomeranz et al. | 36/28 |
| 4,683,709 | 8/1987 | Vasko et al. | 54/66 |
| 4,974,397 | 12/1990 | Ricken | 54/66 |
| 5,018,341 | 5/1991 | Evertson | 54/66 |
| 5,059,467 | 10/1991 | Berkovitz | 428/137 |

FOREIGN PATENT DOCUMENTS

| | | | |
|---|---|---|---|
| 17820 | 5/1935 | Australia | 54/66 |
| 846844 | 9/1939 | France | 54/44.5 |
| 19335 | of 1900 | United Kingdom . | |
| 426078 | 3/1935 | United Kingdom | 54/66 |
| 2090512 | 7/1982 | United Kingdom | 54/66 |

*Primary Examiner*—Robert P. Swiatek

*Attorney, Agent, or Firm*—David H. Semmes

[57] ABSTRACT

Equestrian saddle pads, especially adapted for energy or impact absorption, so as to save the horse. The saddle pad is characterized by a pair of side flaps hinged along a common axially extending top edge alignable with the vertabra of a horse such that each side flap extends over the top sides of the horse. An inner pocket is conformed in each side flap so as to contain an impact absorbing foam core. The foam core includes a center of open cell foam, enclosed by inner and outer layers of closed cell foam. The open cell center provides an impact absorbing air system. The inner and outer layers of closed cell foam contribute to energy absorption and, also, enable the pad to mold to each horse's individual conformation, thereby eliminating pressure points that cause soreness.

15 Claims, 3 Drawing Sheets

IMPACT ABSORBING EQUESTRIAN SADDLE PAD

CROSS-REFERENCES TO RELATED APPLICATIONS

The present invention is related to the applicant's earlier-filed Design Patent Application for a SADDLE PAD Ser. No. 29/007,850), filed May 4, 1993

BACKGROUND OF THE INVENTION

1. Field of the Invention

Equestrian saddle pads, especially adapted for energy or impact absorption, so as to save the horse.

2. Description of the Prior Art

| | | |
|---|---|---|
| RENSMAN | | 709,930 |
| MOSS | (G.B.) | 426,078 |
| TAUBER | | 2,072,188 |
| HANS-JURG | (G.B.) | 2,090,512 |
| VASKO et al. | | 4,683,709 |
| RICKEN | | 4,974,387 |
| BERKOVITZ | | 5,059,467 |
| CLARK | | 568,474 |
| PERRY | | 595,111 |
| HARRIS et al. | | 19,335 |
| RAYFIELD et al. | | 4,242,769 |
| POMERANZ et al. | | 4,471,538 |

The foregoing patents are being discussed in an accompanying Information Disclosure Statement.

SUMMARY OF THE INVENTION

The invention relates to an impact absorbing equestrian saddle pad conformed to span a horse's back and comprising a pair of side flaps hinged along a common axially extending top edge alignable with the vertebra of a horse such that each side flap extends over the top sides of the horse. Each side flap includes a top end converging in a raised pommel, a forward rider knee portion and a rearwardly extending seat portion terminating in a cantle. The flap is conformed by an inner liner and a flexible exterior defining an inner pocket. An impact absorbing foam core is supported within the inner pocket. The foam core includes a center of open cell foam enclosed by inner and outer layers of closed cell foam. The open cell center provides an impact absorbing air system that defuses and distributes the impact of the rider's weight evenly throughout the entire pad, whether landing over a jump or sitting to the trot. The inner and outer layers of closed cell foam contribute to energy absorption and also enable the pad to mold to each horse's individual conformation, thereby eliminating pressure points that cause soreness.

DESCRIPTION OF THE DRAWINGS

In FIGS. 1 and 2, equestrian saddle pad 10 is illustrated as comprising side flaps 12 and 14 hinged along a common axially extending top edge or yoke 16 alignable with the vertebra of a horse, such that each side flap 12, 14 extends over the top sides of the horse. Each side flap encloses an inner energy absorption pocket 20, 22 defined by peripheral flattened edges 40. The individual flaps 12, 14 include reinforced forward edges 19, 21 which converge at their forward top in a pommel portion 24. Lower knee roll portions 23 and 25 are defined beneath pommel 14. The yoke 16 may be of "Nylon"-type tape triple or quadruple stitched both through flexible exterior and inner liner. Similarly, a reinforced trim binding 18 of "Nylon", or the like, may be stitched to the perimeter of both flaps 12 and 14. Pairs of billet straps 28, 30 may be fastened at their ends 32, 34 to the perimeter of the side flap 14 such that the free ends 36, 38 overlap for a "Velcro"-type closure. Similar billet straps 31, 33 may be secured to side flap 12.

As illustrated in FIG. 3 an absorbent "Terry" cloth-type cotton liner 44 may be employed so as to absorb perspiration from the exercising animal. Inner yoke 16 is illustrated as quadruple stitched.

Figure 1:
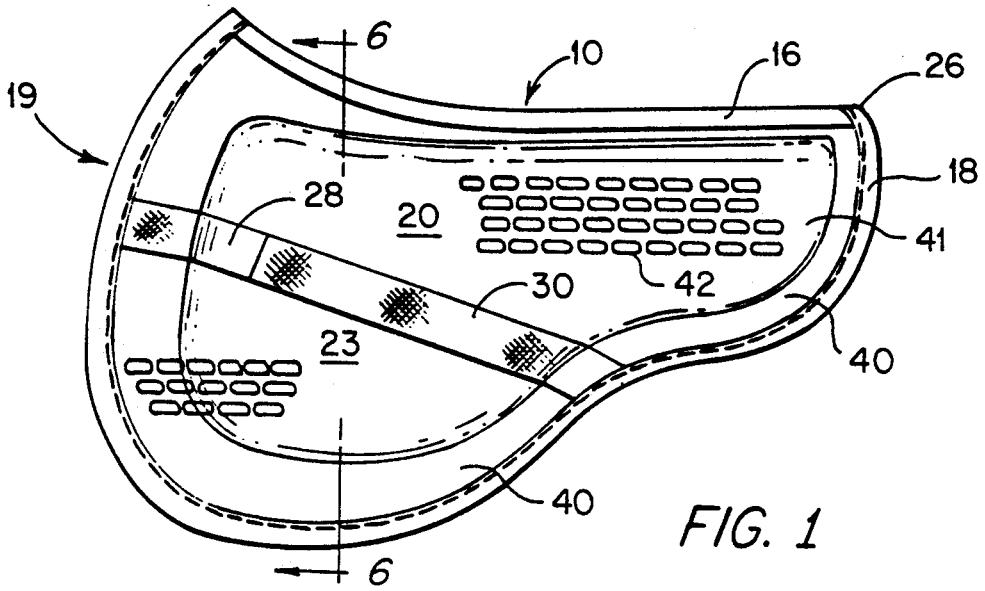
FIG. 1 is a side elevation of the impact absorbing equestrian saddle pad in folded position ready for placement upon the horse.
Figure 2:
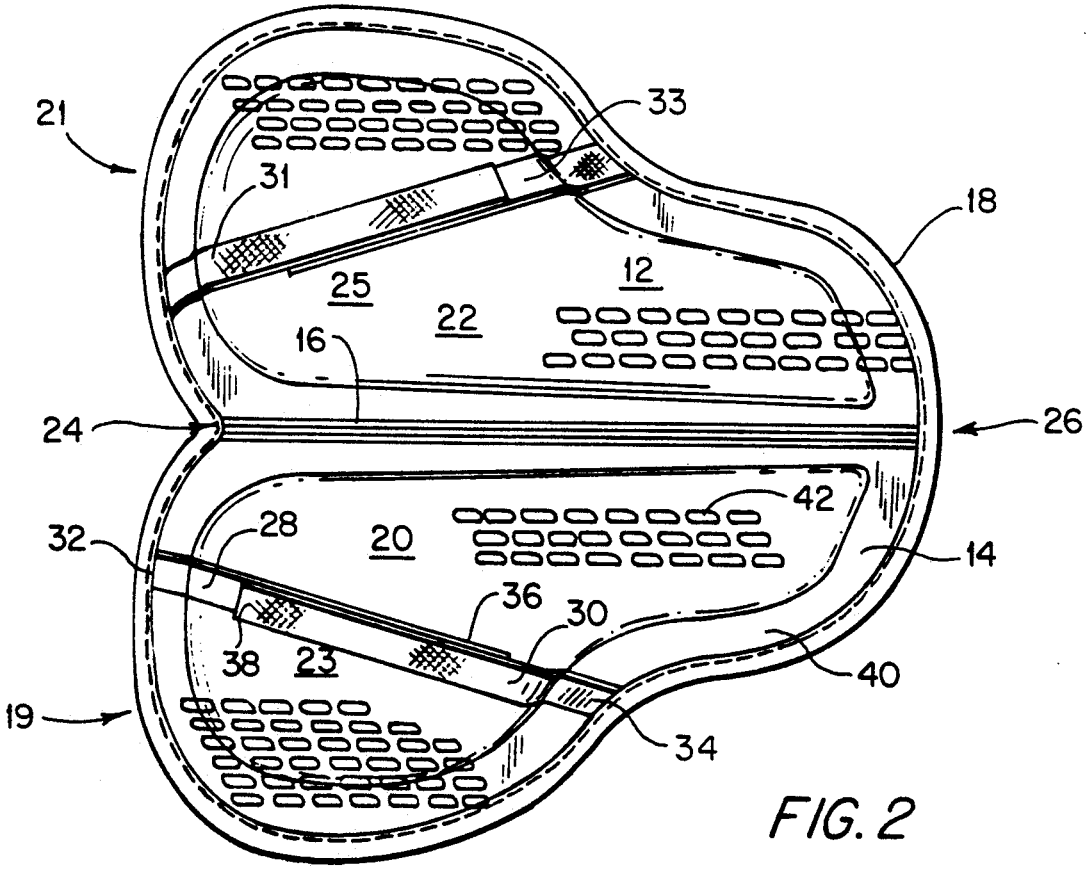
FIG. 2 is a top plan with the side flaps extended outwardly along the longitudinal axis and showing the flexible exterior.
Figure 3:
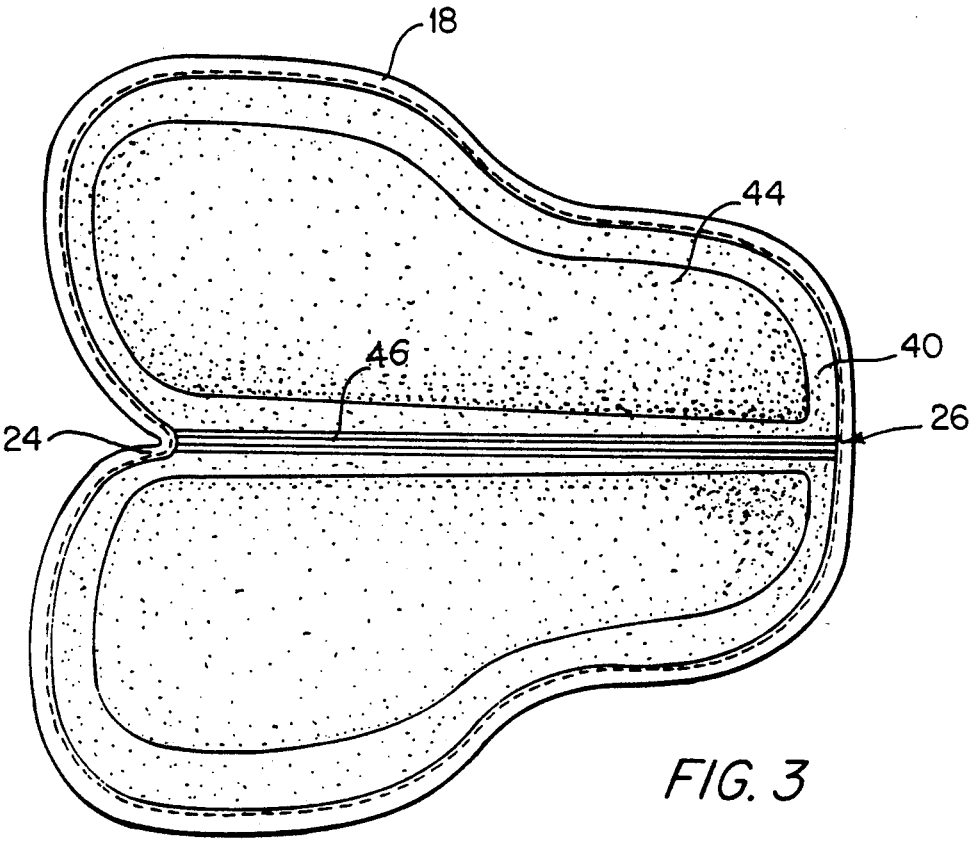
FIG. 3 is a bottom plan with the flaps extended outwardly and showing the "Terry" cloth inner liner.

The waffling effect 42, defined upon each side flap exterior and illustrated in FIGS. 1 and 2 provides flexibility in the exterior 41, as well as structure for ventilation between pad 10 and the equestrian saddle (not illustrated).

Figure 4:
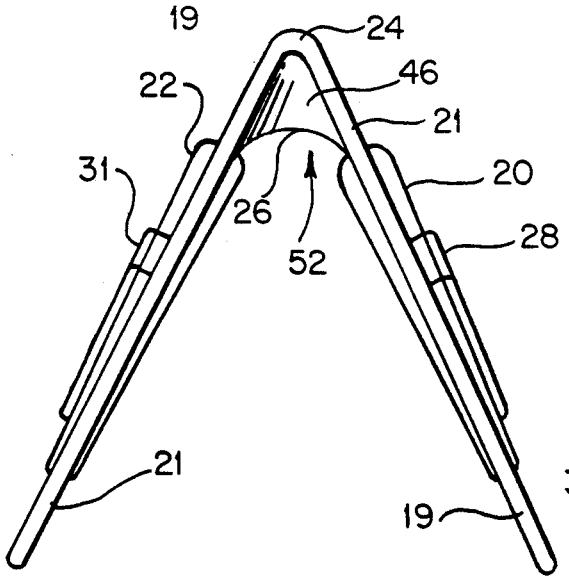
FIG. 4 is a front elevation showing the individual flaps terminating at the forward top end in a pommel.
Figure 5:
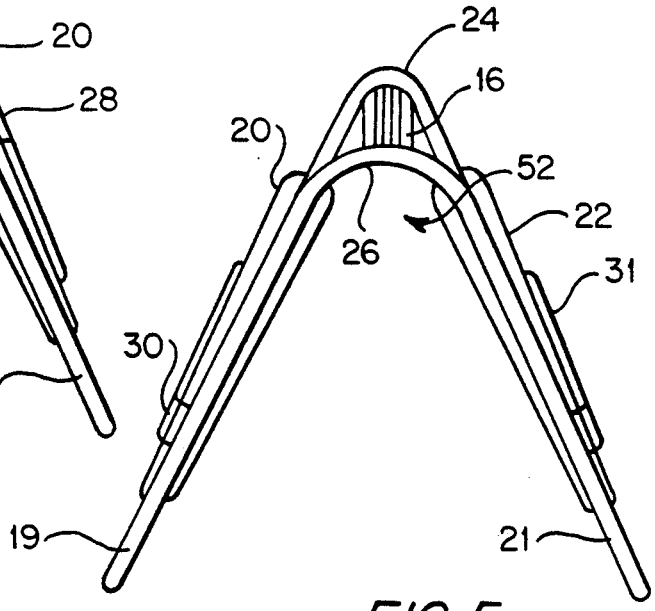
FIG. 5 is a rear elevation showing side flaps terminating in a rear cantle.

In FIG. 4 there is generally illustrated ventilation gap 52 defined beneath inner yoke 46 and extending from pommel 24 to cantle 26, such that an upper portion of the pad may be freely ventilated during exercise.

Figure 6:
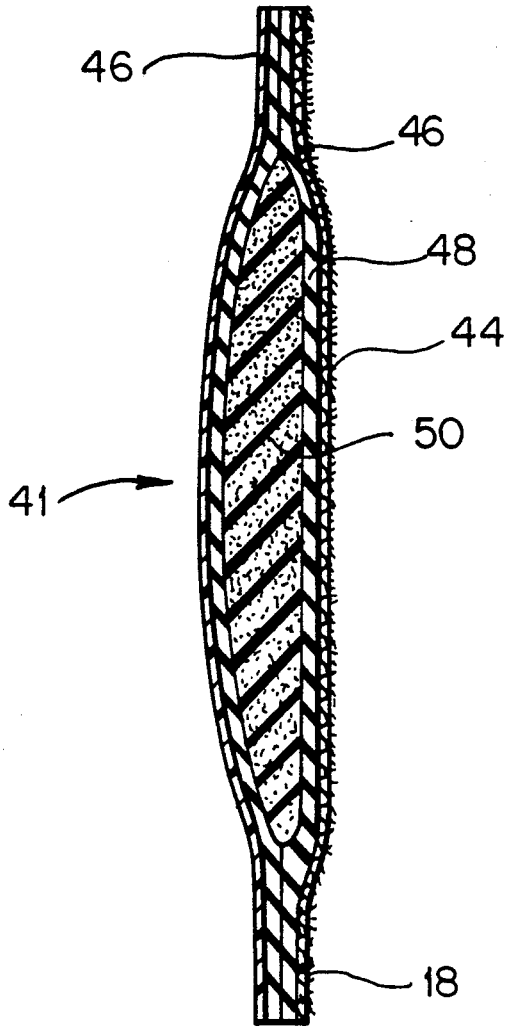
FIG. 6 is a fragmentary vertical section taken along section line 6—6 of FIG. 1 and through a side flap, showing the open cell foam center, enclosed within outer and inner layers of closed cell foam.
Figure 7:
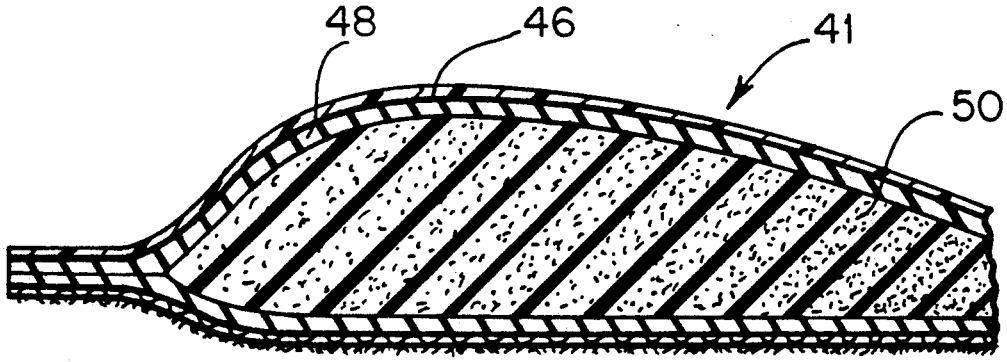
FIG. 7 is an enlarged fragmentary horizontal section taken through the side flap, similarly showing the open cell center enclosed by outer and inner layers of closed cell foam which are laminated respectively with the flexible exterior, as well as the inner layer.

As particularly illustrated in FIGS. 6 and 7, center 50 of open cell foam is enclosed by identical outer and inner layers 48 of closed cell foam approximately one-eighth inch in thickness. An outer layer 46 approximately one-sixteenth inch in thickness of closed cell foam is laminated as at 40, both with flexible exterior 41 and inner liner 44.

The open cell foam of the type manufactured by E. I. duPont de Nemors "polyurethane, 2 lb. density-XJ" is set-up by a "hot needle" method wherein air at ambient pressure is reintroduced to the open cell foam as assembly of the pad is completed. Manifestly, the open cell defines the shape of the impact absorbing area and may be varied widely to accommodate the physique of both the horse and rider. The open cell character of the core enables the shock or impact to be distributed evenly throughout the pad and eliminates the characteristic stress points inherent in sponge or rubber saddle pads. The enclosure of the open cell foam center by thinner layers of closed cell foam assures retention of air within the open cell core and, also, provides suppliers in fitting the pad to the horse.

Also, of course, the pad may be configured to bear exterior identifying initials, numbers or advertisements without departing from the spirit of the invention.

We claim:

1. An energy absorbing equestrian saddle pad conformed to span a horse's back and comprising:

a. a pair of side flaps hinged along a common axially extending top edge alignable with the vertebra of a horse, such that each side flap extends over a top side of the horse, each flap having a top forward end converging in a raised pommel and each flap further including:

i. a forward rider knee portion defined beneath said pommel and a rearwardly extending seat portion terminating in a cantle;

ii. an inner liner and a flexible exterior, defining an inner pocket in each said flap, and iii. an energy absorbing foam core supported within said inner pocket, said foam core including a center of open cell foam enclosed by outer and inner layers of closed cell foam, abutting said inner liner and flexible exterior.

2. An energy absorbing equestrian saddle pad as in claim 1, said inner liner being absorbent.

3. An energy absorbing equestrian saddle pad as in claim 2, said inner liner comprising cotton "Terry" cloth.

4. An energy absorbing equestrian saddle pad as in claim 1, said flexible exterior being reinforced "Nylon".

5. An energy absorbing equestrian saddle pad as in claim 4, said flexible exterior being dimpled, so as to enhance ventilation intermediate said flexible exterior and an equestrian saddle.

6. An energy absorbing equestrian saddle pad as in claim 5, each said center of open cell form being tapered in vertical cross-section, such that the greater portion of open cell foam is supported beneath the rider's seat and legs.

7. An energy absorbing equestrian saddle pad as in claim 6, said saddle pad including a laminate perimeter wherein said outer and inner layers of closed cell foam seal together with said inner liner and said flexible exterior.

8. An energy absorbing equestrian saddle pad as in claim 7, including a trim binding extending along the periphery of each said flap from said pommel downwardly around said knee portion and to said cantle.

9. An energy absorbing saddle pad as in claim 4, including overlapping billet straps secured at the forward and rear ends of said flap rider knee portion, so as to engage beneath the rider's leg.

10. An energy absorbing equestrian saddle pad as in claim 9, said billet straps including interlocking features having "Velcro"-type adjustable closures.

11. An energy absorbing equestrian saddle pad as in claim 10, wherein said axially extending top edge includes reinforcing stitching.

12. An energy absorbing equestrian saddle pad as in claim 11, wherein said center of open cell foam is supported principally in an upper portion of said pad and said outer and inner layers of closed foam define a saddle pad periphery about said inner pocket.

13. An energy absorbing equestrian saddle pad as in claim 12, wherein said center of open cell foam is oblate in vertical cross-section.

14. An energy absorbing equestrian saddle pad as in claim 12, wherein said core of open cell foam in vertical cross-section is wider at the top and thinner at the bottom.

15. An energy absorbing equestrian saddle pad as in claim 12, wherein said center of open cell foam in vertical cross-section defines a rounded outer surface adjacent the rider's seat and legs and a flattened inner surface adjacent the back of the horse.

* * * * *